US006390474B1

(12) United States Patent
Terminel et al.

(10) Patent No.: US 6,390,474 B1
(45) Date of Patent: May 21, 2002

(54) CARD GAME FOR CASINO PLAY

(75) Inventors: Fernando Navarro Terminel, South Lake Tahoe, CA (US); Silvio E Aguilar, Kenner, LA (US)

(73) Assignee: Fair Trade Gaming Corp., Stateline, NV (US)

( * ) Notice: Subject to any disclaimer, the term of this patent is extended or adjusted under 35 U.S.C. 154(b) by 0 days.

(21) Appl. No.: 09/653,800

(22) Filed: Sep. 1, 2000

(51) Int. Cl.[7] ..... A63F 1/00
(52) U.S. Cl. ..... 273/292; 273/274
(58) Field of Search ..... 273/274, 292, 273/309

(56) References Cited

U.S. PATENT DOCUMENTS 5,257,810 A * 11/1993 Schorr et al.
5,669,606 A * 9/1997 Brown
5,758,878 A * 6/1998 Brown
5,876,283 A * 3/1999 Parra et al.
6,062,563 A * 5/2000 De Keller
6,065,753 A * 5/2000 Morosky
6,079,712 A * 6/2000 Eaton et al.
6,129,632 A * 10/2000 Luciano
6,206,374 B1 * 3/2001 Jones
6,241,250 B1 * 6/2001 Webb
6,270,079 B1 * 8/2001 Chamberlain
6,279,910 B1 * 8/2001 De Keller

* cited by examiner

*Primary Examiner*—William M. Pierce
(74) *Attorney, Agent, or Firm*—Charles Hartman

(57) ABSTRACT

Casino clients can wager on a new table wagering game designed expressly for casinos. At least two card hands are dealt, either live using a dealer, or an electronic dealer, using a computer. The first hand to a player position and the second hand is to a banker position. The player can select which hand he to wager on. At the end of play, the hands are evaluated and if the player wagered on the best poker hand, whichever hand that might have been, he wins the game. The house makes a profit from non-qualifying hands, and from failed side-bets.

23 Claims, 1 Drawing Sheet

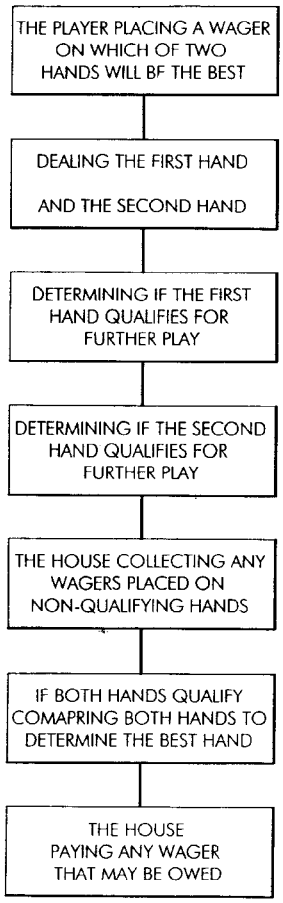

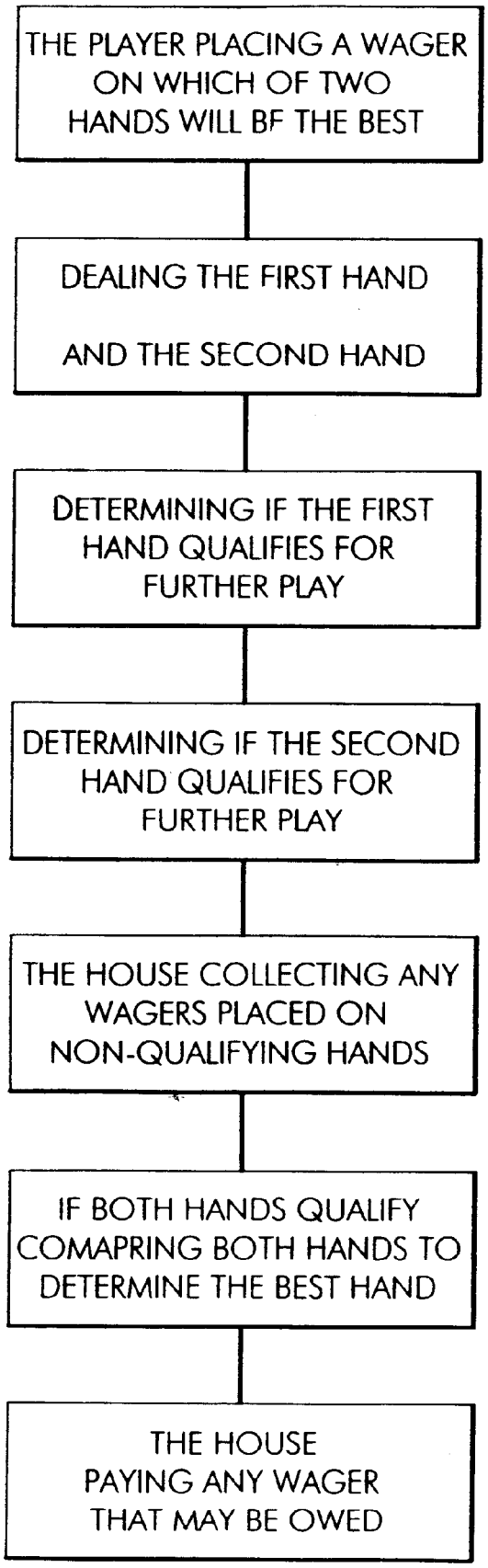
THE PLAYER PLACING A WAGER ON WHICH OF TWO HANDS WILL BF THE BEST
DEALING THE FIRST HAND
AND THE SECOND HAND
DETERMINING IF THE FIRST HAND QUALIFIES FOR FURTHER PLAY
DETERMINING IF THE SECOND HAND QUALIFIES FOR FURTHER PLAY
THE HOUSE COLLECTING ANY WAGERS PLACED ON NON-QUALIFYING HANDS
IF BOTH HANDS QUALIFY COMAPRING BOTH HANDS TO DETERMINE THE BEST HAND
THE HOUSE PAYING ANY WAGER THAT MAY BE OWED

CARD GAME FOR CASINO PLAY

BACKGROUND OF THE INVENTION

1. Field of the Invention

This invention relates to games played for pleasure; in particular, this invention relates to table or slot machine games played in casinos and wagered upon; and most particularly, this invention relates to card games and virtual card games played in casinos at tables for the purpose of wagering.

2. State of the Art

Currently, casinos use a variety of games for wagering. Many of these games are varieties of slot machines, whether mechanical or electronic, and whether the wager is on the position of reels, or video depictions of reels, or other video games, such as poker, blackjack, keno, and other games not usually considered as table games. Despite the popularity of slot machines of various types, particularly the newer video games, poker, blackjack or twenty-one, keno, baccarat, craps and other traditional games played at a table (herein 'a table' will be any location that doesn't include a slot machine) are the foundation of casino play. Because of the critical nature of table games for a casino, there is a constant need for the casinos to develop new table games.

However, given the increasing popularity of slot games, particularly virtual card games where images of cards are displayed on a video monitor or the like, it is also important to provide new slot machine games.

Players are known to enjoy the novelty of new table games. This is because the old games have become too well known by the casino clientele, and because that same clientele perceives some of the traditional games as overly complicated. Moreover, since table games usually have larger stakes than slot machines, casinos have an interest in developing new games for the clientele.

Of the many games developed for the industry, perhaps the best known is Carribean Stud. It has proven to be a great commercial success. However, it has been out for many years now, and is suffering because of the usual being too well known syndrom.

Therefore, it would be advantageous to have a new table game. Such a game must be close enough in its rules to some existing game that the potential players will be attracted to the game, and it must provide a fair profit for the casino and for the players. Now such a game has been invented.

SUMMARY OF THE INVENTION

This invention provides a game to allow players to wager on a new table game for casinos. At least two card hands of five cars are dealt, either live with a first hand to a player and a second hand to a banker, or as a virtual game where two hands of "cards" are dealt and shown on a monitor screen or the like. In live play, the locations of the player's cards and the banker's cards are arbitrary positions on the table top. The player can see both hands and can select which hand he wants to bet on. The hands are evaluated and if the player bet on the best poker hand, whichever hand that might have been, he wins the game. The house makes a profit from the banker and the player if the player does not qualify with a hand that is at least king high.

A first aspect of this invention is a method for wagering comprising:

placing a wager on which of a first hand of a plurality of standard playing cards to be dealt, or a second hand of a plurality of standard playing cards to be dealt will be the better hand;

providing enough standard playing cards for the first hand with a first plurality of standard playing cards and the second hand with a second plurality of standard playing cards;

determining whether the first hand qualifies for further play with at least a one king;

determining whether the second hand qualifies for further play with at least a king;

stopping play and collecting the wager if the wager on a non-qualifying hand;

if the hand qualified, comparing the first hand and the second hand to determine which hand presents the better poker hand; and paying any wager that may be owed.

A second aspect of this invention is a method for wagering comprising:

placing a wager on which of a first hand of five standard playing cards to be dealt to a player position, or a second hand of five standard playing cards to be dealt to a banker position will be the better poker hand;

providing ten standard playing cards, a first hand of five standard playing cards, and a second hand of five standard playing cards;

determining whether the first hand qualifies for further play if it includes at least one king;

determining whether the second hand qualifies for further play if it includes at least one king;

stopping play and collecting the wager if the wager on a non-qualifying hand;

if the hand is qualified, comparing the first hand and the second hand to determine which hand presents the better poker hand; and paying any wager that may be owed.

Another aspect of this invention is a method for wagering comprising:

placing a wager on which of a first hand of five standard playing cards to be dealt to a player position, or a second hand of five standard playing cards to be dealt to a banker position will be the better poker hand;

accepting a side wager on the relative ranking of a hand of standard playing cards selected from the group consisting of the first hand of standard playing cards, the second hand of standard playing cards or both the first hand of standard playing cards and the second hand of standard playing cards;

providing ten standard playing cards, a first hand of five standard playing cards, and a second hand of five standard playing cards;

determining whether the first hand qualifies for further play if it includes at least one king;

determining whether the second hand qualifies for further play if it includes at least one king;

stopping play and collecting the wager if the wager on a non-qualifying hand;

if the hand is qualified, comparing the first hand and the second hand to determine which hand presents the better poker hand;

determining how good each hand wagered on in the side bet is; and, in any sequence, paying off the side bet according to the following schedule:

| | |
|---|---|
| two pairs; | 3:1; |
| three of a kind; | 6:1; |
| straight; | 30:1; |
| flush; | 50:1; |
| full house; | 100:1; |
| four of a kind; | 500:1; |
| straight flush; | 2000:1; and |
| royal flush; | 20,000:1. |

and paying any wager that may be owed.

DETAILED DESCRIPTION OF THE PREFERRED EMBODIMENT

This invention provides casinos with a method for playing a new card game especially adapted for table play in a casino. The game is similar enough to poker that most people will have the basic idea of the basic rules of the game, and what a winning hand might be. Of course, prudent procedure inside the casino dictates that the order of winning hands should be posted at the site of play. There will be at least two players in this game, a player, who will always be a casino client, and a dealer, who will normally be a casino employee.

In one preferred embodiment, the dealer will always be a player, as in the usual twenty-one game. In this embodiment, a dealer ten standard playing cards, five to a location on the table for the "player's cards" and five to a location on the table for the "banker's cards". Although the description herein mentions only casino client, there may be a plurality of players, usually from one to eight, the optimum number being about six. Each player will have placed a wager for the "player's cards" or for the "banker's cards". It will be noted that however many players there are, there is only one hand of "player's cards" dealt, and all the players at the table will bet on that hand or the "banker's cards".

In another preferred embodiment, the dealer will be a computer or similar electronic device, and the player will be a live person. In this embodiment, the player will play the game as a slot machine type game. The rules and odds recited herein will be unaffected by the player not being a human. The playing cards dealt by a computer, a processor or similar digital device will herein be referred to as "virtual cards" and will be visual representations of a standard deck of cards. That is, the virtual deck will have 52 possible cards to deal in suits of clubs, hearts, diamonds and spades, each suit having thirteen cards. In that sense, the virtual deck is one other method of providing "standard playing cards". In the discussion that follows, all mention of real cards and standard cards will be entirely applicable to virtual cards, except that virtual cards are not dealt by a dealer.

Usually, the standard playing cards will all be dealt face up, that is the players and the dealer will know the relative value of each hand as the game progresses. However, it may be preferable to deal one card face down, preferably the first card, to enhance the excitement of the game.

In one preferred embodiment, after the ten standard playing cards are dealt, the hands of the dealer and the player may then be evaluated. Before any evaluation of the quality of the hands the determination has to be made whether the hands qualify. A hand must have at least a single king or better to qualify. If either hand does not qualify, all bets made for that hand are lost, and the further play on that hand is stopped. If the other hand qualifies, all bets made for that hand are paid and the play restarts. If both hands qualify, the hand with the best standard poker hand wins. For example, if the player bet on the Player hand and the Player hand is indeed the best standard poker hand, he wins. Similarly, if the player bet on the Banker hand, and the banker has the best hand, the player wins. However, if the player wagered that the Player hand would be best and the Banker hand is the best, the player will loose, and if the player wagered that the Banker hand would be best, and the Player hand is best, he will loose again. If there are a plurality of players playing the game, each of them may bet on the player's hand or the banker's hand independently of the other players. This embodiment is preferred if the speed of dealing a plurality of games is an important consideration.

A side bet can be made in the play of this game. In the side bet, the player bets a small amount, usually only $1.00, on how the relative ranking of a hand will be as ranked as a typical poker hand. The player can bet on either or both hands for this side bet. The winner of a particular hand is determined by the quality of his hand as a standard poker hand. Typical pay-outs for normal highball poker hands are shown below in the following schedule:

| | |
|---|---|
| two pairs; | 3:1; |
| three of a kind; | 6:1; |
| straight; | 30:1; |
| flush; | 50:1; |
| full house; | 100:1; |
| four of a kind; | 500:1; |
| straight flush; | 2000:1; and |
| royal flush; | 20,000:1. |

In another embodiment, the dealer may deal two standard playing cards, one to the player's hand and one to the banker's hand. At this point in play, wagers may again be accepted. Typically, the minimum amount of such intermediate wagers would be at least twice what the player wagered at the beginning of the game. This may occur after the first card is dealt, after the second card is dealt, after the third card is dealt and, less preferably, after the fourth card is dealt. It cannot happen after the fifth card is dealt, since that is the end of the game.

In a variation of the standard game described above, different factors may be used to determine the winning hand. One of these factors may be the "worst" hand in a lowball method of determining hand ranking. Then the winning hand for a particular game will be the lowest hand based on hand ranking in lowball poker. Use of wild standard playing cards, dealing fewer or more standard playing cards than ten, and other variations of standard poker may be allowed in increase consumer acceptance of the game, and increase the excitement of the game. The minimum number of standard playing cards allowed to be dealt is two, and more cards, three, or four are greatly preferred. If fewer than four standard playing cards are dealt the "best poker hand" will be determined for the number of cards dealt. If more cards are dealt, the usual method of scoring will be figuring out which hand holds the best five card standard hand. Here, too, the best hand may be the best lowball hand.

EXAMPLES

These Examples show various particularly preferred embodiments of the claimed invention. They are not intended to limit the scope of the appended claims in any way.

Example 1

Example 1 shows a typical hand of play in the game described herein above. This example shows a hand in play in the game. The hand could be played with real standard playing cards or with virtual cards.

| | | | | | | |
|---|---|---|---|---|---|---|
| Banker hand | Q | J | 9 | 5 | 3 | unsuited |
| Player hand | J | 8 | 7 | 4 | 2 | unsuited |

Both hands fail to qualify. All players loose. If any side bets were made, they are lost as well.

Example 2

This Example shows a hand in play in the game. The hand could be played with real standard playing cards or with virtual cards.

| | | | | | | |
|---|---|---|---|---|---|---|
| Banker hand | Q | J | 9 | 5 | 3 | unsuited |
| Player hand | K | J | 8 | 7 | 4 | unsuited |

Banker fails to qualify, so those players who bet on the Banker loose. Those players who bet on the Player win. All side bets will be lost on both hands because neither hand has at least two pairs.

Example 3

Shows an example of a hand in play in the game. The hand could be played with real standard playing cards or with virtual cards.

| | | | | | | |
|---|---|---|---|---|---|---|
| Banker hand | Q | J | 9 | 9 | 3 | unsuited |
| Player hand | 10 | 9 | 8 | 7 | 6 | unsuited |

Both hands qualify. The Player hand outranks the Banker hand, so those who bet on the Player hand win and those who bet on the Banker hand loose. In this case, if a player made a side bet on the Banker hand, he would loose, but if he made a side bet on the Player hand, he would win $30.00 (according to the pay table chart).

This invention has been described with reference to specific embodiments and examples thereof. Alterations, modifications, and other changes will invariably suggest themselves to those of ordinary skill in the art. It is intended that the scope of the invention be determined solely by reference to the appended claims, and that the appended claims encompass all such alterations, modifications, and changes.

We claim:

1. A method for wagering comprising:

placing a wager on which of a first hand of a plurality of cards to be dealt, or a second hand of a plurality of cards to be dealt will be the better hand;

providing enough standard playing cards for the first hand and the second hand;

determining whether the first hand qualifies for further play with at least a king;

determining whether the second hand qualifies for further play with least a king;

stopping play and collecting the all wagers on non-qualifying hands;

if the both hands qualify, comparing the first hand and the second hand to determine which hand presents the better poker hand; and paying any wager that may be owed.

2. The method of wagering of claim 1 wherein both the first hand and the second hand include five standard playing cards.

3. The method for wagering of claim 1 wherein the standard playing cards are virtual standard playing cards.

4. The method for wagering of claim 1 wherein the method further includes the following steps:

at the time of the placing the wager step, accepting a side wager on the relative ranking of a hand of standard playing cards selected from the group consisting of the first hand of standard playing cards, the second hand of standard playing cards or both the first hand of standard playing cards and the second hand of standard playing cards;

after the comparing step, determining how good each hand wagered on in the side bet is.

5. The method for wagering of claim 4 wherein the method further includes paying off the side bet wager after the determining according to the following schedule:

two pairs; 3:1;

three of a kind; 6:1;

straight; 30:1;

flush; 50:1;

full house; 100:1;

four of a kind; 500:1;

straight flush; 2000:1; and royal flush; 20,000:1.

6. The method of wagering of claim 4 wherein the standard playing cards are virtual standard playing cards.

7. The method for wagering of claim 1 wherein the first hand of a plurality of standard playing cards is dealt to a player position and the second hand of a plurality of standard playing cards is dealt to a banker position.

8. The method of playing a card game of claim 1 wherein the method further includes the step of paying the house a percentage of the amount wagered on the hand dealt to the banker position.

9. The method of playing a card game of claim 8 wherein the house percentage for the bankers hand is in between about 3 percent and 10 percent.

10. The method of playing a card game of claim 1 wherein the method further includes the step of paying the house a percentage of the total amount wagered on the particular hand.

11. The method of playing a card game of claim 1 wherein determining the better poker hand is done by determining the best high hand in standard poker.

12. The method of playing a card game of claim 1 wherein paying the wager is based on a progressive amount that accumulates in the jackpot.

13. The method of playing a card game of claim 1 wherein the best poker hand is determined by determining the lowest hand based on hand ranking in lowball poker.

14. A method for wagering comprising:

placing a wager on whether a first hand of five standard playing cards to be dealt to a player position, or a second hand of five standard playing cards to be dealt to a banker position will be the better poker hand;

providing ten standard playing cards, a first hand of five standard playing cards, and a second hand of five standard playing cards;

determining whether the first hand qualifies for further play if it includes at least one king;

determining whether the second hand qualifies for further play if it includes at least one king;

stopping play and collecting the wager if the wager on a non-qualifying hand;

if the hand is qualified, comparing the first hand and the second hand to determine which hand presents the better poker hand; and paying any wager that may be owed.

15. The method for wagering of claim 14 wherein the standard playing cards are virtual standard playing cards.

16. The method for wagering of claim 14 wherein the method further includes the following steps:

at the time of the placing the wager step, accepting a side wager on the relative ranking of a hand of standard playing cards selected from the group consisting of the first hand of standard playing cards, the second hand of standard playing cards or both the first hand of standard playing cards and the second hand of standard playing cards;

after the comparing step, determining how good each hand wagered on in the side bet is.

17. The method for wagering of claim 16 wherein the method further includes paying off the side bet wager after the determining according to the following schedule:

two pairs; 3:1;

three of a kind; 6:1;

straight; 30:1;

flush; 50:1;

full house; 100:1;

four of a kind; 500:1;

straight flush; 2000:1; and royal flush; 20,000:1.

18. The method of wagering of claim 16 wherein the standard playing cards are virtual standard playing cards.

19. The method of playing a card game of claim 14 wherein the players may modify their wager depending on a first incomplete hand of standard playing cards dealt to the player position and a second incomplete hand of standard playing cards dealt to the banker position.

20. The method of playing a card game of claim 14 wherein determining the better poker hand is done by determining the best high hand in standard poker.

21. The method of playing a card game of claim 14 wherein paying the wager is based on a progressive amount that accumulates in the jackpot.

22. The method of playing a card game of claim 14 wherein the best poker hand is determined by determining the lowest hand based on hand ranking in lowball poker.

23. A method for wagering comprising:

placing a wager on whether a first hand of five standard playing cards to be dealt to a player position, or a second hand of five standard playing cards to be dealt to a banker position will be the better poker hand;

accepting a side wager on the relative ranking of a hand of standard playing cards selected from the group consisting of the first hand of standard playing cards, the second hand of standard playing cards or both the first hand of standard playing cards and the second hand of standard playing cards;

providing ten standard playing cards, a first hand of five standard playing cards, and a second hand of five standard playing cards;

determining whether the first hand qualifies for further play if it includes at least one king;

determining whether the second hand qualifies for further play if it includes at least one king;

stopping play and collecting the wager if the wager on a non-qualifying hand;

if the hand is qualified, comparing the first hand and the second hand to determine which hand presents the better poker hand;

determining how good each hand wagered on in the side bet is;

Paying off the side bet according to the following schedule:

two pairs; 3:1;

three of a kind; 6:1;

straight; 30:1;

flush; 50:1;

full house; 100:1;

four of a kind; 500:1;

straight flush; 2000:1; and royal flush; 20,000:1; and paying any wager that may be owed.

* * * * *